US011284199B2

(12) United States Patent
Kim

(10) Patent No.: US 11,284,199 B2
(45) Date of Patent: Mar. 22, 2022

(54) FLAT SPEAKER HAVING MULTILAYER AND DUAL TRACK MOVING COIL

(71) Applicants: Dong-Man Kim, Seoul (KR); Chongqing XinPing Semiconductor Co., Ltd., Chongqing (CN)

(72) Inventor: Dong-Man Kim, Seoul (KR)

(73) Assignees: Dong-Man Kim; Chongqing XinPing Semiconductor Co., Ltd.

( * ) Notice: Subject to any disclaimer, the term of this patent is extended or adjusted under 35 U.S.C. 154(b) by 35 days.

(21) Appl. No.: 16/967,897

(22) PCT Filed: Jan. 24, 2019

(86) PCT No.: PCT/KR2019/001024
§ 371 (c)(1),
(2) Date: Aug. 6, 2020

(87) PCT Pub. No.: WO2019/156398
PCT Pub. Date: Aug. 15, 2019

(65) Prior Publication Data

US 2021/0058710 A1 Feb. 25, 2021

(30) Foreign Application Priority Data

Feb. 6, 2018 (KR) ..... 10-2018-0014587

(51) Int. Cl.
*H04R 9/06* (2006.01)
*H04R 9/04* (2006.01)
(Continued)

(52) U.S. Cl.
CPC ..... *H04R 9/047* (2013.01); *H01F 7/081* (2013.01); *H01F 27/2804* (2013.01); *H04R 1/06* (2013.01);
(Continued)

(58) Field of Classification Search
CPC . H04R 1/06; H04R 7/04; H04R 9/025; H04R 9/046; H04R 9/047; H04R 9/048;
(Continued)

(56) References Cited

U.S. PATENT DOCUMENTS 7,099,488 B2 * 8/2006 Bohlender ..... H04R 7/04 381/408
8,953,834 B2 2/2015 Kim
(Continued)

FOREIGN PATENT DOCUMENTS

CN 103563398 A 2/2014
KR 10-2012-0016395 2/2012
(Continued)

OTHER PUBLICATIONS

International Search Report from PCT/KR2019/001024, dated May 23, 2019, pp. 1-4, including English translation.

*Primary Examiner* — Huyen D Le
(74) *Attorney, Agent, or Firm* — The Belles Group, P.C.

(57) ABSTRACT

The present invention relates to a flat panel speaker with which a speaker can be implemented by maximizing the number of coil turns and reduce unnecessary coil lines and weight. The flat panel speaker may include a pair of magnetic bodies with a movable coil plate therebetween, the magnetic bodies being spaced apart from each other, and movable coils patterned and printed in a printed circuit board (PCB) track shape, and laminated in even numbered layers with two or more layers, wherein: the movable coils are patterned and printed on the movable coil plate of each layer as a first coil track and a second coil track; each of the first coil track and the second coil track comprises a horizontal and vertical line coil; the horizontal line coil is formed by connecting a plurality of lines in parallel; and the vertical line coil is formed in a single line.

7 Claims, 6 Drawing Sheets

(51) Int. Cl.

| | |
|---|---|
| ***H01F 7/08*** | (2006.01) |
| ***H01F 27/28*** | (2006.01) |
| ***H04R 1/06*** | (2006.01) |
| ***H04R 9/02*** | (2006.01) |
| ***H04R 31/00*** | (2006.01) |
| ***H04R 7/04*** | (2006.01) |

(52) U.S. Cl.
CPC ..... *H04R 7/04* (2013.01); *H04R 9/025* (2013.01); *H04R 9/046* (2013.01); *H04R 9/06* (2013.01); *H04R 31/006* (2013.01); *H01F 2027/2809* (2013.01); *H04R 2209/041* (2013.01)

(58) Field of Classification Search
CPC .. H04R 9/06; H04R 2209/041; H04R 31/006; H01F 2027/2809; H01F 27/2804; H01F 7/081
See application file for complete search history.

(56) References Cited

U.S. PATENT DOCUMENTS

| | | | | |
|---|---|---|---|---|
| 10,321,237 | B2 * | 6/2019 | Min | H04R 9/047 |
| 2014/0044287 | A1 * | 2/2014 | Kim | H04R 1/06 381/191 |
| 2014/0233766 | A1 | 8/2014 | Kim | |
| 2018/0027333 | A1 | 1/2018 | Mao et al. | |

FOREIGN PATENT DOCUMENTS

| | | |
|---|---|---|
| KR | 10-1147904 | 5/2012 |
| KR | 10-1196295 | 11/2012 |
| KR | 10-2017-0006126 | 1/2017 |
| KR | 20170006126 A | 1/2017 |

* cited by examiner

FLAT SPEAKER HAVING MULTILAYER AND DUAL TRACK MOVING COIL

CROSS-REFERENCE TO RELATED PATENT APPLICATIONS

The present application is a U.S. national stage application under 35 U.S.C. § 371 of PCT Application No. PCT/KR2019/001024, filed Jan. 24, 2019, which claims priority to Korean Patent Application No. 10-2018-0014587, filed Feb. 6, 2018. The disclosures of the aforementioned priority applications are incorporated herein by reference in their entireties.

TECHNICAL FIELD

The present invention relates to a flat panel speaker, and more specifically, to a flat panel speaker with which a high-quality and high-capacity speaker may be implemented by maximizing the number of coil turns and reducing unnecessary coil lines and weight.

BACKGROUND ART

A movable coil plate used for flat panel speaker is spirally wound or printed and patterned on a single surface or both surfaces of a plate-like coil bases.

In the movable coil plate, when current flows through a movable coil, the current flowing at that time generates a magnetic field that expands and shrinks at the same frequency as an audio signal around the movable coil, and since the movable coil is subjected to the magnetic field generated by a magnet inside a speaker unit, the movable coil plate moves vertically while interacting with the magnetic field generated at the movable coil corresponding to the magnetic field. Since the movable coil plate is connected to a vibration plate of the speaker unit, the vibration plate generates push out air while moving vertically and generates a sound by the vibration of air.

These flat panel speakers tend to have been developed to have increased output capacity, gradually decreasing sizes, and long structures, and in order to increase the output capacity of the flat panel speakers, development of a flat panel speaker having a structure in which a plurality of magnetic circuits are coupled has emerged as an important problem.

However, in case of a movable coil film laminated in multiple layers, number of windings should be maximally increased to raise inductive electromotive force, but the value of resistance increases as the number of windings increases to cause inefficiency, and conversely, when the value of resistance is preset, the number of windings may not be increased and the inductive electromotive force may not be increased, and thus, there is a difficulty in implementing a high-output speaker.

Korean Registered Patent No. 10-1147904 discloses a "flat panel speaker having multilayer PCB pattern movable coil film.

This patent implements a multilayer movable coil film so that the inductive electromotive force thereof can be increased by controlling the impedance thereof, but it is only possible to implement a multilayer structure with four or more layers, it is difficult to improve the demerits of an increase in weight and unnecessary left and right-side transverse vibration forces occurring due to a current flow according to the multilayer structure in left and right-side track lines that are misaligned by approximately 90 degrees with the positive direction of magnetic field of the movable coil plate, it is difficult to maximize the inductive electromotive force by increasing the number of effective straight track lines while decreasing the number of side surface idle track lines, and it is not possible to implement a flat panel speaker equipped with a dual PCB pattern movable coil.

DISCLOSURE OF THE INVENTION

Technical Problem

The problem to be solved by the present invention to solve the above-limitations is to provide a flat panel speaker with which inductive electromotive forces may be remarkably increased by maximally increasing the number of coil turns of PCB pattern movable coil films laminated in multiple layers to increase the inductive electromotive forces.

In addition, the present invention provides a flat panel speaker with which the vibration force of the movable coil may be maximized by relatively decreasing the weight of a coil plate while increasing the number of coil turns.

In addition, the purpose of the present invention is to provide a high-quality and high-capacity flat panel speaker in which a multilayer-structured coil plate and the patterning of each layer into a dual track structure coil may be implemented by relatively decreasing the weight of the coil plate.

Technical Solution

In order to solve the limitations, a flat panel speaker, including multilayer and dual track movable coils according to the present invention, includes: a pair of magnetic bodies with a movable coil plate therebetween, the magnetic bodies being spaced apart from each other; and movable coils patterned and printed in a printed circuit board (PCB) track shape, and laminated in even numbered layers with two or more layers, wherein: the movable coils are patterned and printed on the movable coil plate of each layer as a first coil track and a second coil track; each of the first coil track and the second coil track comprises a horizontal line coil and a vertical line coil; the horizontal line coil is formed by connecting a plurality of lines in parallel; and the vertical line coil is formed in a single line.

Here, the first coil track and the second coil track formed in the movable coil plate of each layer may be mutually connected in series or in parallel.

Here, the magnetic bodies each may include a magnet, an upper magnet on an upper surface of the magnet, and a lower magnet on a lower surface of the magnet, and magnets being disposed in two left and right arrangements.

Here, the length of each of the magnets may be formed in the same as or smaller than widths of the movable coils.

Here, the movable coil plates may each include one or more among a lead wire connection terminal, a coil end terminal of each of the movable coils, or a coil connection terminal for the movable coils.

Here, the lead wire connection terminal may include a thin film metal structure with a semi-circular shape.

Here, the horizontal line coil may be formed by vertical parallel connection of two lines, the vertical line coil may be formed in a single line, and the two lines of the horizontal line coil may be connected to the single line.

Advantageous Effects

According to the above-described configuration of the present invention, the embodiments of the disclosed technology may exhibit effects including the following merits. However, this does not mean that the embodiments of the disclosed technology should include all these, and the scope of the disclosed technology should not be understood to be limited by the embodiments.

The present invention may provide a flat panel speaker that can remarkably increase inductive electromotive force by maximally increasing the number of coil turns of PCB pattern movable coil films laminated in a multilayer in order to increase the maximum inductive electromotive force.

In addition, the vibration force of the movable coil may be maximized by increasing the number of coil turns and relatively decreasing the weight of coil plates, and as the weight of the coil plate is relatively decreased, it is possible to pattern as coils of dual track structure on a multilayer structure coil plates and each of the layers and provide a high-quality and high-capacity flat panel speaker.

MODE FOR CARRYING OUT THE INVENTION

Figure 1:
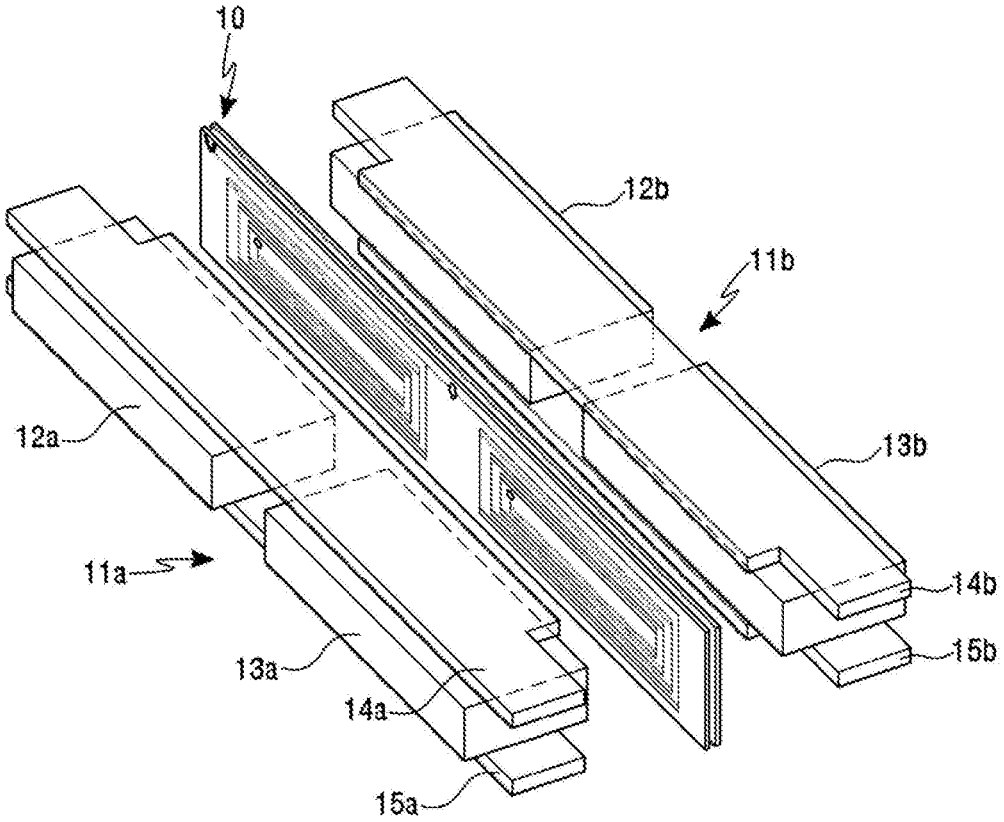
FIG. 1 is a schematic perspective view of a flat panel speaker equipped with multilayer and dual track movable coils according to the present invention.

Hereinafter, described, with reference to accompanying drawings, will be the structure and acting effect of a flat panel speaker equipped with multilayer and dual track movable track according to the present invention.

Detailed descriptions on specific embodiments illustrated in the accompanying drawings are associated with the accompanying drawings, and the drawings are considered as a portion about the descriptions of the entirety of the invention. The statement on directions or orientations is provided only for convenience of description, and does not have an intention of limiting the scope of the present invention.

Specifically, the terms indicating positions such as "below, above, horizontal, vertical, upper side, lower side, upward, downward, upper part, lower part", or derived words thereof (for example, "horizontally, upward, or upward") should be understood with reference to the descriptions related to the drawings. In particular, these relative words are provided only for convenience of description, and thus do not require that the apparatus of the present invention should be configured or operate in a specific direction.

In addition, unless described otherwise, the terms indicating mutual coupling relationship between constituents such as "mounted, attached, coupled, connected, or mutually connected" constituents may mean a state in which individual constituents are indirectly or directly attached, connected, or fixed, and the terns should be understood as the terms including not only a state of movably attached, connected, or fixed, but also a unmovable state.

When reference numerals are assigned to the components in constituents in each of the drawings, it should be noted that the same components, although illustrated in different drawings, are allowed to have the same reference numerals if possible. In addition, hereinafter, detailed descriptions on the relevant well-known functions or configurations will be ruled out in order not to unnecessarily obscure subject matters of the present invention.

Figure 2:
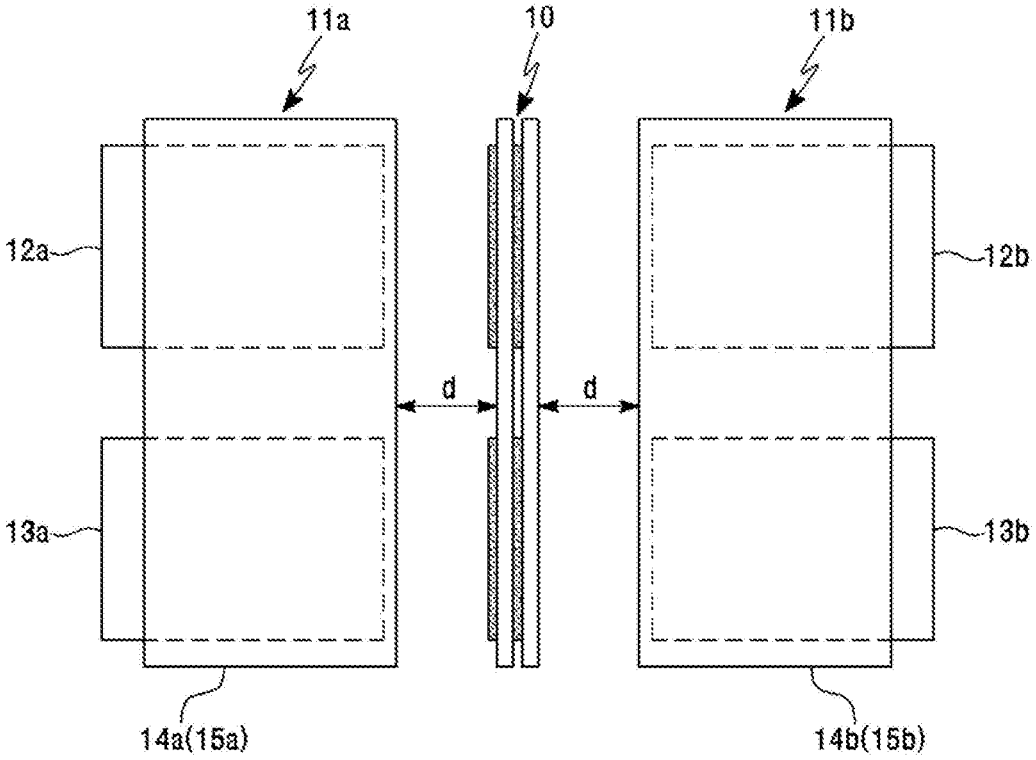
FIG. 2 is a schematic plan view of a flat panel speaker equipped with a multilayer and dual track movable coil according to the present invention.

FIG. 1 is a schematic perspective view of a flat panel speaker equipped with multilayer and dual track movable coils according to the present invention, and FIG. 2 is a schematic plan view of a flat panel speaker equipped with a multilayer and dual track movable coil according to the present invention.

As illustrated in FIGS. 1 and 2, a flat panel speaker to which movable coils of the present invention are applied is as illustrated in FIGS. 1 and 2. Here, a damper, a lead wire, a base frame and a vibration plate are omitted.

The flat panel speaker includes a movable coil plate 10 and a pair of magnetic bodies 11*a* and 11*b* which are spaced apart a predetermined interval d from the movable plate 10, the movable coil plate 10 being positioned between the pair of magnetic bodies 11*a* and 11*b*.

The pair of mutually facing magnetic bodies 11*a* and 11*b* may have the same configuration and may be composed of: magnets 12*a*, 13*a*, 12*b* and 13*b*; upper magnet plates 14*a* and 14*b* positioned on the upper surfaces of the magnets 12*a*, 13*a*, 12*b*, and 13*b*; and lower magnet plates 15*a* and 15*b* positioned on the lower surfaces of the magnets 12*a*, 13*a*, 12*b* and 13*b*.

The magnets 12*a*, 13*a*, 12*b*, and 13*b* provided inside the magnetic bodies 11*a* and 11*b* have reverse polarities so that an attractive force acts between the magnets, and the movable coil plate 10 favorably maintains the same distance d so as to receive the same magnetic force from the both-side magnetic bodies 11*a* and 11*b*.

The speaker configured as such is attached inside a base frame (not shown), and a vibration plate (not shown) for transmitting vibration energy to the upper end of a movable coil plate 10 may be formed.

Each of the upper magnet plates 14*a* and 14 and the lower magnet plates 15*a* and 15*b* are composed of a single plate, and the magnets 12*a*, 13*a*, 12*b* and 13*b* are disposed such that the two magnets 12*a* and 13*a* on one side and the two magnets 12*b* and 13*b* on the other side are disposed while spaced apart a predetermined distance from each other.

The magnets 12*a*, 13*a*, 12*b* and 13*b* are formed in two pairs so as to match the length of a dual track effective straight line section, and the upper magnet plates 14*a* and 14*b* and the lower magnet plates 15*a* and 15*b* are integrally formed with the two magnets and may prevent inward bending due to the attractive forces of the N and S poles.

In the present invention, considering that magnets are disposed up to left and right unnecessary tack portions in positioning the magnet, which are one of the most important components of a flat panel speaker, on the left and right sides of the movable coil plate, and thus the non-efficient left and right vibration force is maintained, it is possible to achieve an effect of removing non-efficiency and reducing the length of the magnets to thereby remarkably lower costs by disposing the length of the magnets only in the straight line track (horizontal line coil 201 of FIG. 4; coil effective section) of the movable coils.

The movable coil plate 10 may be configured in a multilayer laminated in two or more even number of layers (2, 4, 6 . . . ), and specific tracks and patterns of the movable coil of the movable coil plate 10 will be described below.

The movable coil may be patterned and printed on a printed circuit board (PCB).

Figure 3:
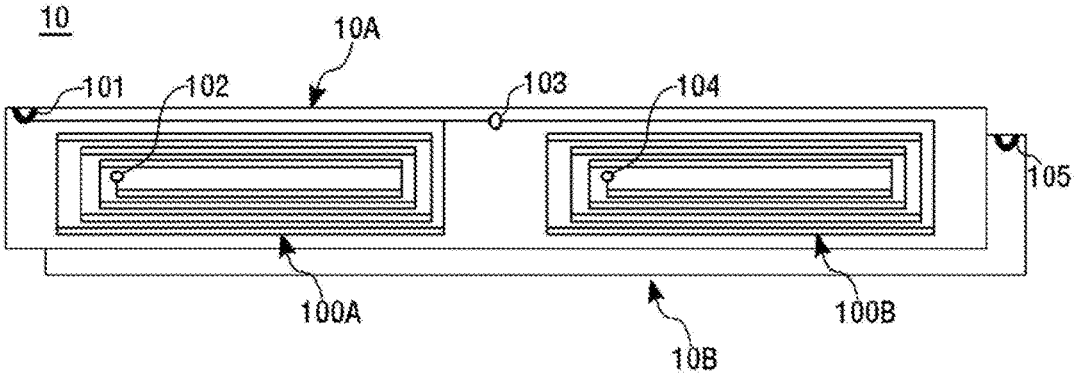
FIG. 3 is a structural view of a dual track coil pattern of a movable coil plate in a flat panel speaker equipped with multilayer and dual track movable coils according to the present invention.
Figure 4:
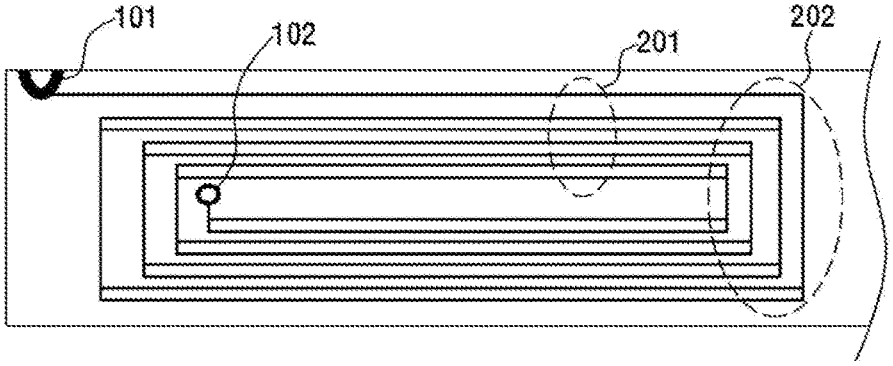
FIG. 4 is a structural view of a coil pattern of a movable coil plate in a flat panel speaker equipped with multilayer and dual track movable coils according to the present invention.

FIG. 3 is a structural view of a dual track coil pattern of a movable coil plate in a flat panel speaker equipped with multilayer and dual track movable coils according to the present invention, and FIG. 4 is a structural view of a coil pattern of a movable coil plate in a flat panel speaker equipped with multilayer and dual track movable coils according to the present invention.

Referring to FIG. 3, a movable coil plate 10 applied to the present invention has a multilayer layer structure with two or more layers (even-numbered layers), and the movable coil plate 10 illustrated in FIG. 3 is illustrated as an example thereof.

The movable coil plate 10 form a pair by the lamination of a first movable coil plate 10A and a second movable coil plate 10B.

In the first and second movable coil plates 10*a* and 10B, a first coil tack 100A and a second coil tack 100B, which are two dual coil tracks, are patterned and formed on a single coil plate, and via holes may be formed in required positions for mutual electrical connection.

Reference numerals 101 and 105 are lead wire connection terminals, reference numerals 102 and 104 are coil end terminals, and reference numeral 103 is a connection terminal for connecting the first coil track 100A and the second coil track 100B.

Referring to FIG. 4, each of the coil tracks 100A and 100B has the pattern as that in FIG. 4.

The coil tracks 100A and 100B are mutually connected in a shape in which a horizontal line coils 202 and a vertical line coils 202 are wound inward or unwind outward and have one track structure.

In general, in case of a flat panel speaker, the coil pattern structure of a movable coil plate may be said to be the core thereof, a current flow in the track portions of the left and right coil lines of a movable coil is changed by approximately 90 degrees, and thus does not generate an inductive electromotive force of vertical vibration, but generates a left and right-side vibration force and it is thus necessary to remove or minimize the left and right vibration force.

In addition, the left and right-side tracks unnecessarily increase only the weight of the coil line (copper wire) and are inversely proportional to the efficiency of vertical vibration of the speaker.

Thus, the present invention proposes a structure in which a left and right vibration force may be reduced while improving the inductive electromotive of vertical vibration of the movable coil plate, and a movable coil structure that may reduce the weight of the coil line, and this results in the design structure like that in FIG. 4.

That is, the direction of magnetic field and the direction of the current changed by approximately 90 degrees may not affect the vertical vibration of an actuating driver and rather generate a force of vibrating in the left-right direction, and therefore may minimize the number of lines or this portion to suppress unnecessary transverse vibration force, and may minimize the coil line (copper wire) of an ideal coil track and reduce the weight thereof to contribute to the improvement of negative pressure, and may overcome a typical technical limitation by maximizing the number of line turns of the portion of the horizontal line coil 201 which is a straight line effective coil track through which current flows in the positive direction of the magnetic field.

The coils are connected in parallel in a plurality of lines in the horizontal line coil 201, are combined in a single line and pass the vertical line coil 202 section, and are reconnected in parallel and pass in a plurality of lines in the horizontal line coil 201 which have reverse-direction current flow, and while repeating this in a spiral form, the coils form en end terminal 102 of an inner tack.

The end terminal 102 of the inner track may be connected in series to a second movable coil plate 10B using the via holes.

The lead wire connection terminals 101 and 105 may be formed in a lower end section in a half moon shape having a thin film metal structure in order to facilitate lead wire soldering.

In a flat panel speaker having a multilayer structured PCB pattern movable coil film that has an electrical connection structure like those in FIGS. 1 to 4, it is possible to implement a high-output speaker through an increase in inductive electromotive force by dividing the coil into an effective section and an non-effective section and actually differentiating the left and right vibration force while maximally increasing the number of turns, it is possible to reduce the weight of a coil plate due to excessive use of a copper wire by configuring the non-effective coil line (vertical line coil 202), and an effect of reducing the total weight of the speaker may be achieved by having a structure of a pair of magnets so that the magnets also have sizes corresponding to the size of straight line track section (horizontal line coil 201) of the effective section.

Figure 5:
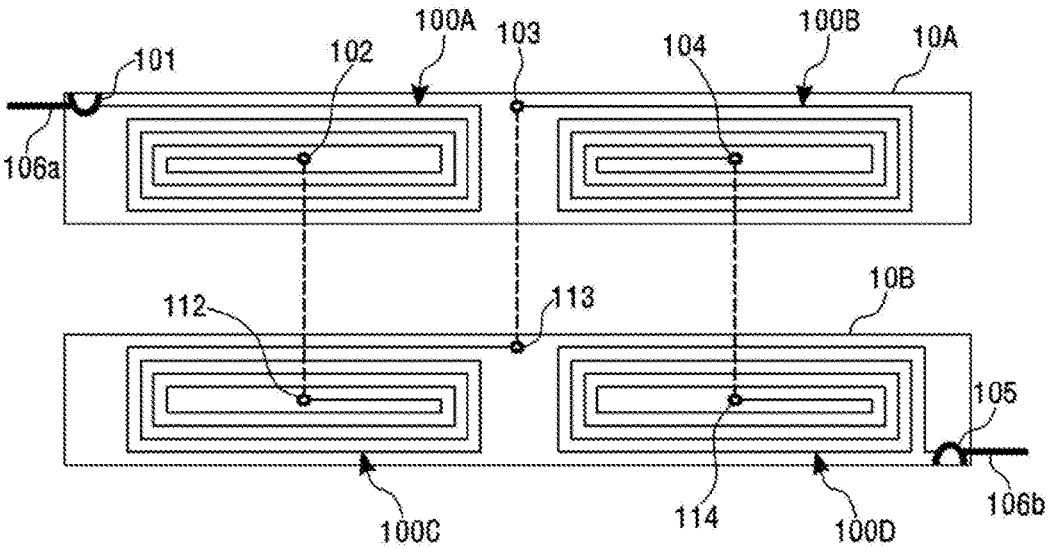
FIG. 5 is a conceptual view of connection of a double-layer-structured movable coil plate in a flat panel speaker equipped with multilayer and dual track movable coils according an embodiment of the present invention.
Figure 6:
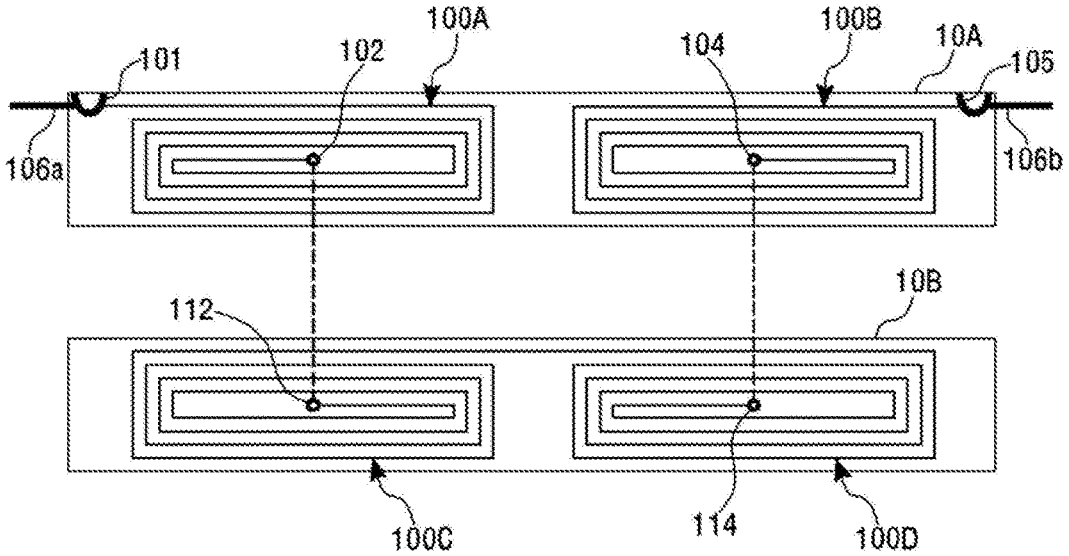
FIG. 6 is a conceptual view of connection of a double-layer-structured movable coil plate in a flat panel speaker equipped with multilayer and dual track movable coils according to another embodiment of the present invention.
Figure 7:
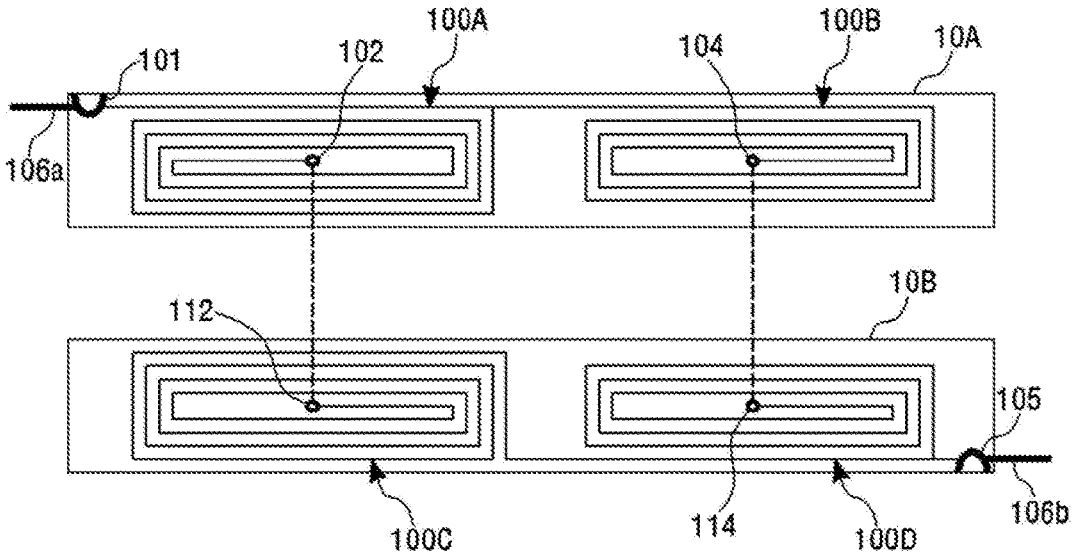
FIG. 7 is a conceptual view of connection of a double-layer-structured movable coil plate in a flat panel speaker equipped with multilayer and dual track movable coils according to still another embodiment of the present invention.

FIG. 5 is a conceptual view of connection of a double-layer-structured movable coil plate in a flat panel speaker equipped with multilayer and dual track movable coils according an embodiment of the present invention, FIG. 6 is a conceptual view of connection of a double-layer-structured movable coil plate in a flat panel speaker equipped with multilayer and dual track movable coils according to another embodiment of the present invention, and FIG. 7 is a conceptual view of connection of a double-layer-structured movable coil plate in a flat panel speaker equipped with multilayer and dual track movable coils according to still another embodiment of the present invention.

FIGS. 5 and 6 are examples in which a first movable coil plate 10A and a second movable coil plate 10B are connected to each other in series, and FIG. 7 illustrates an example in which a first movable coil plate 10A and a second movable coil plate 10B are connected to each other in parallel.

As illustrated in FIGS. 5 to 7, the present invention has a multilayer structure with two or more layers and a dual track coil is patterned and formed in a track shape on a coil plate of a single layer.

The two layers of the coil plate may form a pair and the first movable coil plate 10*a* and the second movable coil plate 10B may be connected in series or in parallel.

Referring to FIG. 5, in the first movable coil plate 10A, a first lead wire connection terminal 101, a first coil track 100A, a second coil track 100B, coil end terminals 102 and 104, and a coil connection terminal 103 are formed.

In the second movable coil plate 10B, a third coil track 1000, a fourth coil track 100D, coil end terminals 112 and 114, and a second lead wire connection terminal 105 are formed.

Lead wires 106*a* and 106*b* are respectively soldered and connected to the first and second lead wire connection terminals 101 and 105.

The movable coil is formed in a track form while inwardly wound starting from the first lead wire connection terminal 101, and the coil end terminal 102 is formed at the tip of the track form (form the first coil track 100A), and the movable coil is connected to the coil end terminal 112 of the second movable coil plate 10B (form the third coil track 100C) through a via hole from the coil end terminal 102, is connected to the coil end terminal 113 while being outwardly wound, and is connected to the coil connection terminal 103 of the first movable coil plate 103 and forms the second coil track 100B while being inwardly wound. Subsequently, the movable coil is connected to the coil end terminal 114 through a via hole from the coil end terminal 104, forms the fourth coil track 100D while being outwardly wound in a track form, is connected to the second lead wire connection terminal 105, and is patterned and formed so as to be electrically connected to the lead wire 106*b*.

Referring to FIG. 6, in the first movable coil plate 10A, a first lead wire connection terminal 101, a first coil track 100A, a second coil track 100B, coil end terminals 102 and 104, and a second lead wire connection terminal 105 are formed.

In the second movable coil plate 10B, a third coil track 1000, a fourth coil track 100D, and coil end terminals 112 and 114 are formed.

Lead wires 106*a* and 106*b* are respectively soldered and connected to the first and second lead wire connection terminals 101 and 105.

A movable coil is formed in a track form while inwardly wound starting from the first lead wire connection terminal 101, and the coil end terminal 102 is formed at the tip of the track form (form the first coil track 100A), and the movable coil is connected to the coil end terminal 112 of the second movable coil plate 10B through a via hole from the coil end terminal 102, forms the third coil track 100C while being outwardly wound, is then connected to the coil on the second coil track 100B side, and forms the fourth coil track 100D while being inwardly wound. Subsequently, the movable coil is connected from the coil end terminal 114 to the coil end terminal 104 of the first movable coil plate 10B through a via hole, forms the second coil track 100B while being outwardly wound in a track form, is connected to the lead wire connection terminal 105, and is electrically to the lead wire 106*b*.

Referring to FIG. in the first movable coil plate 10A, a first lead wire connection terminal 101, a first coil track 100A, a second coil track 100B, coil end terminals 102 and 104 are formed.

In the second movable coil plate 10B, a third coil track 1000, a fourth coil track 100D, coil end terminals 112 and 114, and a second lead wire connection terminal 105 are formed.

Lead wires 106*a* and 106*b* are respectively soldered and connected to the first and second lead wire connection terminals 101 and 105.

A movable coil is formed in a track form while inwardly wound starting from the first lead wire connection terminal 101, and the coil end terminal 102 is formed at the tip of the track form (form the first coil track 100A), and the movable coil is connected to the coil end terminal 112 of the second movable coil plate 10B through a via hole from the coil end terminal 102, forms the third coil track 1000 while being outwardly rewound, is then connected to the fourth coil track 100D and forms the fourth coil track 100D while being inwardly wound, and is connected to the second lead wire connection terminal 105 and is electrically connected to the lead wire 106*b*. Subsequently, the movable coil is connected from the coil end terminal 114 to the coil end terminal 104 of the second coil track 100B through a via hole.

One side of the first coil track 100A is connected to the tip section of the second coil track 100B, and the tip section of the third coil track 100C and the tip section of the fourth coil track 100D may be configured to be mutually connected, and the first movable coil plate 10*a* and the second movable coil plate 10B may be implemented so as to be a state of being mutually connected in parallel.

Figure 8:
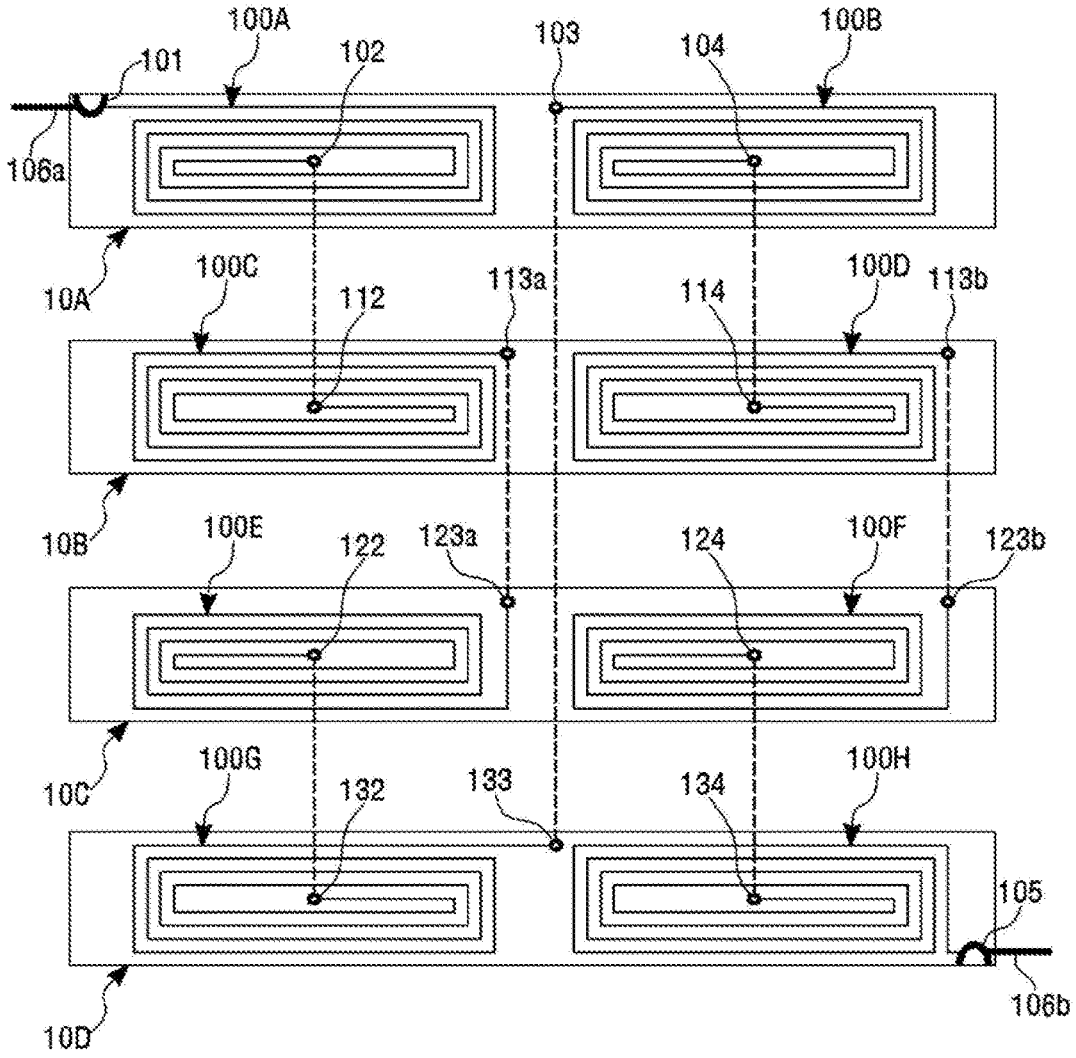
FIG. 8 is a conceptual view of connection of a movable coil plate having four or more layers in a flat panel speaker equipped with multilayer and dual track movable coils according an embodiment of the present invention.
Figure 9:
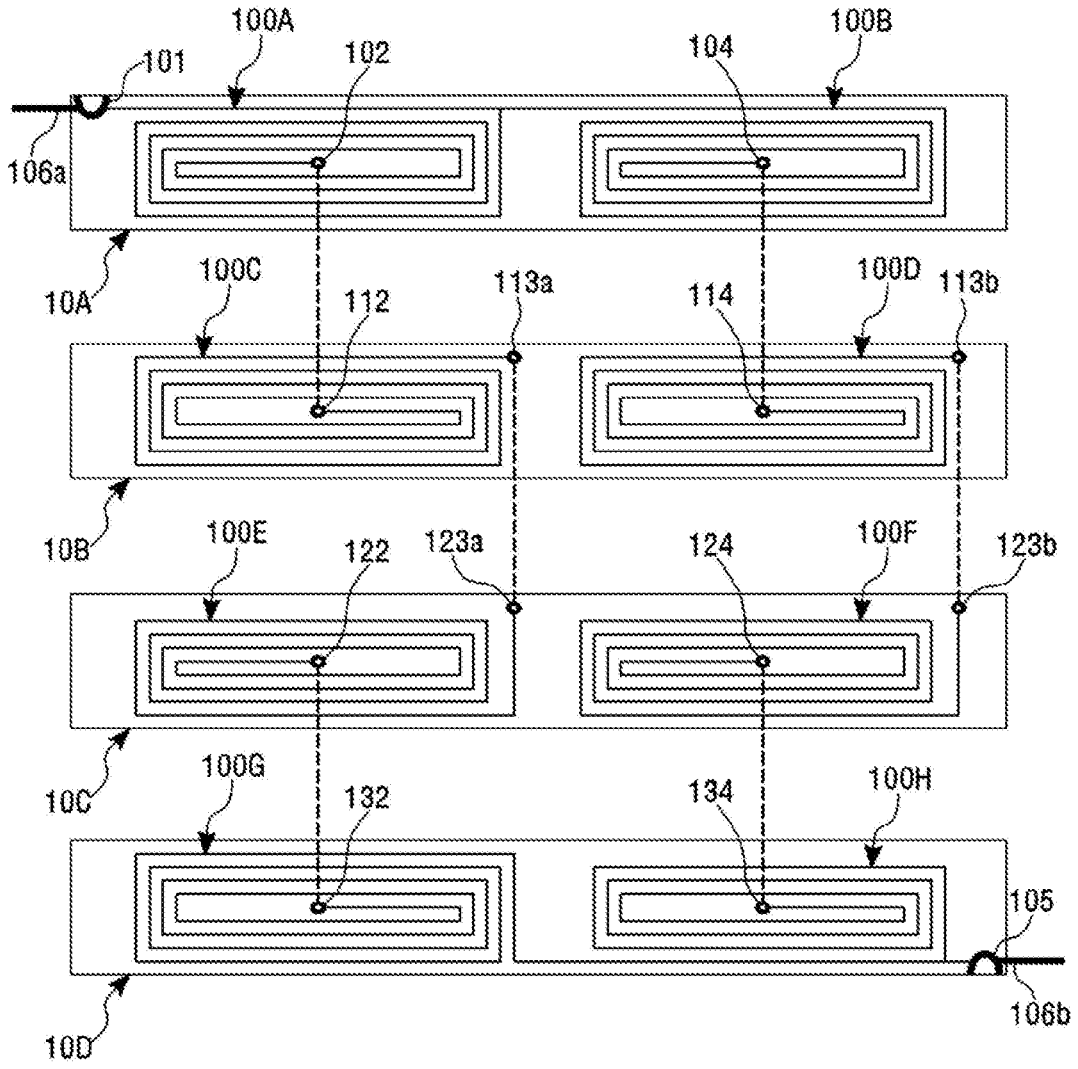
FIG. 9 is a conceptual view of connection of a movable coil plate having four or more layers in a flat panel speaker equipped with multilayer and dual track movable coils according another embodiment of the present invention.
Figure 10:
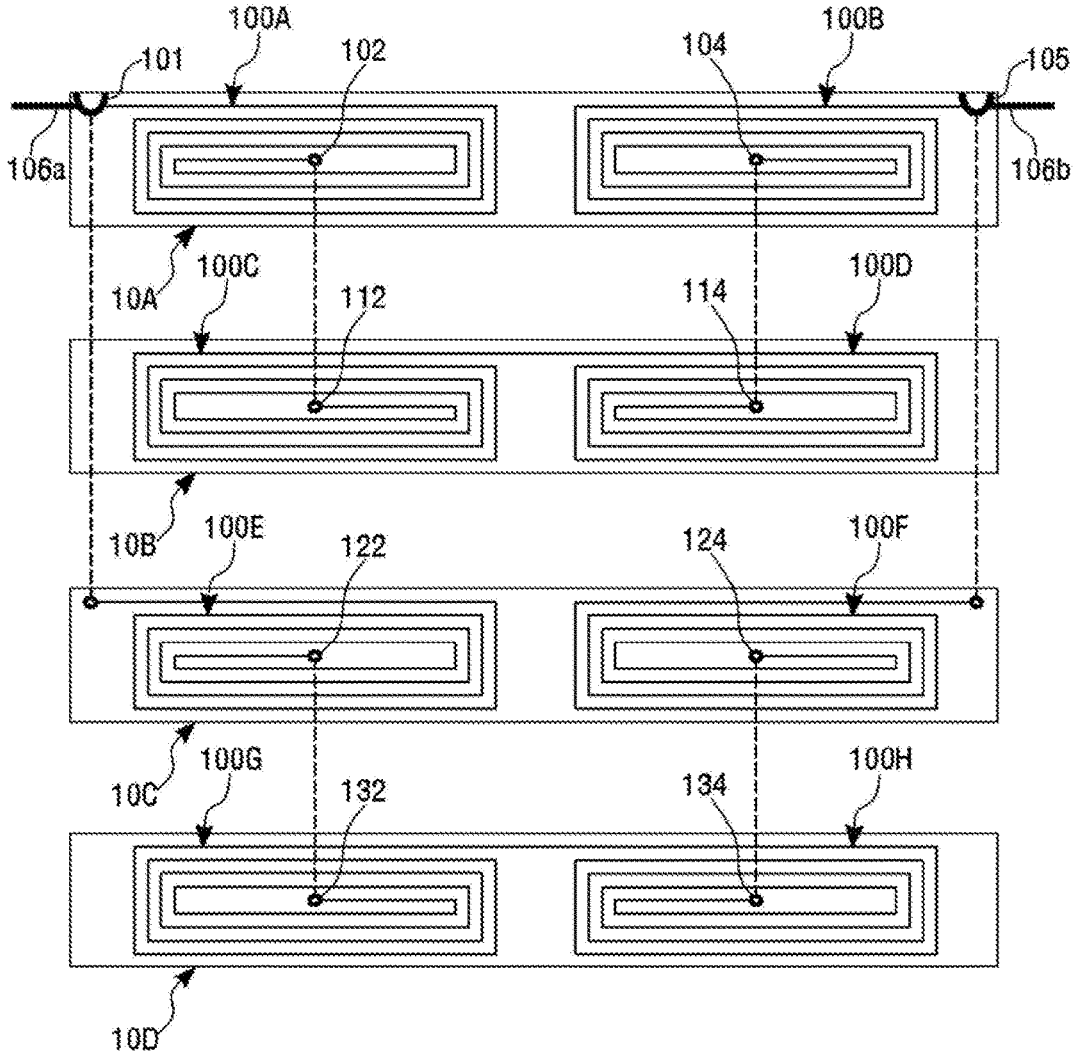
FIG. 10 is a conceptual view of connection of a double-layer-structured movable coil plate in a flat panel speaker equipped with multilayer and dual track movable coils according to still another embodiment of the present invention.

FIG. 8 is a conceptual view of connection of a movable coil plate having four or more layers in a flat panel speaker equipped with multilayer and dual track movable coils according an embodiment of the present invention, FIG. 9 is a conceptual view of connection of a movable coil plate having four or more layers in a flat panel speaker equipped with multilayer and dual track movable coils according another embodiment of the present invention, and FIG. 10 is a conceptual view of connection of a double-layer-structured movable coil plate in a flat panel speaker equipped with multilayer and dual track movable coils according to still another embodiment of the present invention.

FIG. 8 illustrates a configuration in which coil tracks of laminated movable coil plates 10A, 10B, 10C and 10D are mutually connected in series, and FIGS. 9 and 10 are examples illustrating first coil tracks 100A, 1000, 100E, and 100G are connected in parallel with the second coil tracks 100B, 100D, 100F, and 100H.

FIGS. 8 to 10 illustrate examples of series connection and parallel connection between coil tracks and this may be applied in the same manner to pattern forming when movable coil plates are implemented in an even number of layers more than four layers.

As described above, a flat panel speaker equipped with multilayer and dual track movable coils of the present invention may maximize the inductive electromotive force of vertical vibration while using a dual track, and attenuate left and right vibration energy and raise vertical vibration energy by dividing the movable coil into an effective section (horizontal line coil) and a non-effective section (vertical line coil) and patterning and configuring the non-effective section coil in a single line and the effective section coil in a plurality of line patterns, and reduce production costs and raise the efficiency of the speaker by configuring the vertical line coil in a single line to reduce the amount of patterned and formed copper and configuring magnets in a pair divided conforming to the effective section of the coil.

Features, structures, effects, etc. described in the above embodiments are incorporated into at least one embodiment of the present disclosure, but are not limited to only one embodiment. Moreover, features, structures, and effects exemplified in one embodiment may easily be combined and modified for other embodiments implemented by those skilled in the art in the field to which embodiments belong. Therefore, these combinations and modifications should be construed as falling within the scope of the present disclosure.

In addition, although embodiments have mainly been described, it will be understood that the embodiments do not limit the present invention, and various modifications and applications that are not exemplified so far may be devised by those skilled in the art without departing from fundamental characteristics of the embodiments. For example, each of components specifically described in examples may be implemented with modification. In addition, differences related to variations and modifications should be construed to be within the scope of the present invention defined in appended claims.

The invention claimed is:

1. A flat panel speaker comprising multilayer and dual track movable coils, the flat panel speaker comprising:

a pair of magnetic bodies with a movable coil plate therebetween, the magnetic bodies being spaced apart from each other; and movable coils patterned and printed in a printed circuit board (PCB) track shape, and laminated in even numbered layers with two or more layers, wherein:

the movable coils are patterned and printed on the movable coil plate of each layer as a first coil track and a second coil track;

each of the first coil track and the second coil track comprises a horizontal line coil and a vertical line coil;

the horizontal line coil is formed by connecting a plurality of lines in parallel;

the vertical line coil is formed in a single line; and spiral coil tracks are formed while the plurality of lines and the single line are repeated.

2. The flat panel speaker of claim 1, wherein the first coil track and the second coil track formed in the movable coil plate of each layer are mutually connected in series or in parallel.

3. The flat panel speaker of claim 1, wherein the magnetic bodies each comprise a magnet, an upper magnet on an upper surface of the magnet, and a lower magnet on a lower surface of the magnet, and the magnets are disposed in two left and right arrangements.

4. The flat panel speaker of claim 3, wherein the length of each of the magnets is formed in a same as or smaller than widths of the movable coils.

5. The flat panel speaker of claim 1, wherein the movable coil plate comprises one or more among a lead wire connection terminal, a coil end terminal of each of the movable coils, or a coil connection terminal for the movable coils.

6. The flat panel speaker of claim 5, wherein the lead wire connection terminal comprises a thin film metal structure with a semi-circular shape.

7. The flat panel speaker of claim 1, wherein:

the horizontal line coil is formed by vertical parallel connection of two lines;

the vertical line coil is formed in a single line; and the two lines of the horizontal line coil are connected to the single line.

* * * * *